US006173788B1

(12) United States Patent
Lembcke et al.

(10) Patent No.: US 6,173,788 B1
(45) Date of Patent: Jan. 16, 2001

(54) WELLPACKER AND A METHOD OF RUNNING AN I-WIRE OR CONTROL LINE PAST A PACKER

(75) Inventors: Jeffrey J. Lembcke; Michael Carmody, both of Houston, TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/056,146

(22) Filed: Apr. 7, 1998

(51) Int. Cl.[7] ..... E21B 23/06

(52) U.S. Cl. ..... 166/387; 166/65.1; 166/242.3; 166/179

(58) Field of Search ..... 166/65.1, 179, 166/106, 387, 97.5, 89.2, 89.3, 242.3, 188, 187

(56) References Cited

U.S. PATENT DOCUMENTS

| | | | | |
|---|---|---|---|---|
| 56,234 | * | 7/1866 | Latham | 166/242.3 |
| 2,253,092 | * | 8/1941 | Pranger | 166/65.1 |
| 3,330,355 | * | 7/1967 | Yancey | 166/97.5 |
| 3,451,481 | * | 6/1969 | Lanmon II | 166/89 |
| 3,797,573 | * | 3/1974 | Crowe | 166/321 |
| 3,899,631 | * | 8/1975 | Clark | 166/187 |
| 4,125,289 | * | 11/1978 | Huff et al. | 299/4 |
| 4,453,595 | * | 6/1984 | Lagus et al. | 166/303 |
| 4,573,537 | * | 3/1986 | Hirasuna et al. | 166/387 |
| 4,589,482 | * | 5/1986 | Bayh, III | 166/105.5 |
| 4,627,490 | * | 12/1986 | Moore | 166/65.1 |
| 4,805,698 | * | 2/1989 | Baugh et al. | 166/272.3 |
| 4,852,649 | * | 8/1989 | Young | 166/189 |
| 5,035,286 | | 7/1991 | Fitzgibbon, Jr. | 166/187 |
| 5,641,019 | * | 6/1997 | Stout et al. | 166/179 |

* cited by examiner

*Primary Examiner*—David Bagnell
*Assistant Examiner*—Sunil Singh
(74) *Attorney, Agent, or Firm*—Duane, Morris & Heckscher LLP

(57) ABSTRACT

A packer that accommodates a control line or I-wire within its sealing element. The sealing element has a longitudinal groove to accommodate the I-wire or control line such that, when the sealing element is compressed, it closes around the I-wire or control line to envelope it as the sealing element makes peripheral contact with the casing, tubular, or the wellbore. The control line or I-wire does not go through the mandrel or body of the packer, and additional joints used in prior techniques for accommodating control lines or I-wires going around packers is eliminated.

10 Claims, 2 Drawing Sheets

WELLPACKER AND A METHOD OF RUNNING AN I-WIRE OR CONTROL LINE PAST A PACKER

FIELD OF THE INVENTION

The field of the invention relates to packers which can accommodate a wire or control line going past the packer externally when it is set.

BACKGROUND OF THE INVENTION

Frequently, packers need to be set in wellbores, but access below them is also necessary to allow other downhole components to be actuated by hydraulic pressure through a control line, or by electronic means through an I-wire. I-wire is defined to encompass a cable of any type, including fiber optic, or conductor which conducts power or signals between the surface and downhole and any points in between.

Prior designs have made provisions for such needs through the mandrel of the packer. Thus, for example, to allow a control line to pass through the packer body, the mandrel had connections above and below. The control line would be assembled with the string and connected to the underside of the packer mandrel. Thereafter, another connection would be put in the upper end of the packer mandrel and the control line would be continued with the tubing string so that it would eventually reach the surface. A pressure source would then be connected to the control line at the surface to allow for actuation of the downhole components hydraulically. This procedure could be repeated if multiple control lines were to be used.

Wires or cables could be run through the mandrel body in a similar manner. The wire required a terminal connection above and below the packer mandrel to seal around the periphery of the cable, or the packer mandrel body itself could be prewired from the top and bottom connections. In this manner, leakage through the mandrel body was avoided by using the sealed electrical connections at the top and bottom of the mandrel body.

Both these techniques for running control line or I-wire through the mandrel body had undesirable aspects. The most prevalent undesirable aspect of the prior technique was the addition of joints. With the control line, the additional joints present a potential leak path which, if sufficiently severe, would undermine the operation of the downhole components relying upon pressurization in the control line. Similarly, with the I-wire, the necessity of connections above and below the packer posed potential problems not only from a leakage point of view, but also from a reliability aspect with regard to the circuits being jeopardized by infiltration of wellbore fluids. Accordingly, an object of the present invention is to facilitate the running of I-wires or control lines around a packer in a manner where additional joints are not required, thus avoiding the potential problems of the prior techniques. These and other objectives of the present invention will be better understood by a review of the description of the preferred embodiment below.

SUMMARY OF THE INVENTION

A packer is disclosed which accommodates a control line or I-wire within its sealing element. The sealing element has a longitudinal groove to accommodate the I-wire or control line such that, when the sealing element is compressed, it closes around the I-wire or control line to envelope it as the sealing element makes peripheral contact with the casing, tubular, or the wellbore. The control line or I-wire does not go through the mandrel or body of the packer, and additional joints used in prior techniques for accommodating control lines or I-wires going around packers is eliminated. The I-wire can be run inside a control line and the assembly run through the sealing element of the packer.

BRIEF DESCRIPTION OF THE DRAWINGS

FIG. 1 is a sectional view showing the I-wire or control line positioned in a longitudinal groove in the sealing element during run-in.

DETAILED DESCRIPTION OF THE PREFERRED EMBODIMENT

Figure 1:
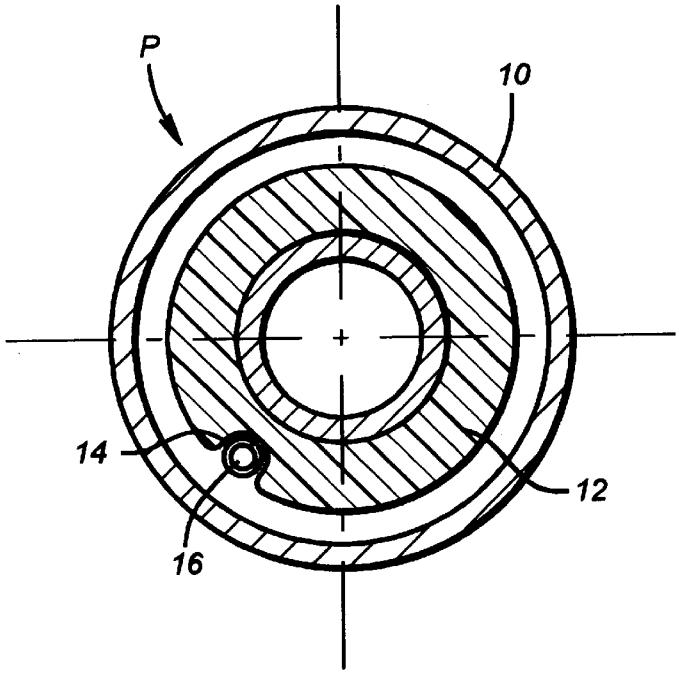

FIG. 1 illustrates the run-in position of a packer P, showing the casing 10 and the sealing element 12 in a relaxed condition. The sealing element 12 has a longitudinal groove 14 in which is placed a control line or Iwire or an I-wire inside a control line or other elongated object 16. In the preferred embodiment depicted in FIG. 1(*a*) the longitudinal groove is a circle like passage or opening, identified by element 14', and located at the outer surface or periphery of the sealing element. The control line or I-wire 16 runs longitudinally the full extent of groove 14, and extends further from the surface to a downhole location below the packer P for operation of other downhole equipment. The packer P is preferably a noninflatable type which is actuated by relative movement of packer components in a known manner, which squeeze the element 12 from above and below to extend it into contact with the casing 10. Although casing 10 is illustrated, other tubulars downhole or the wellbore itself can be used in conjunction with the packer P without departing from the spirit of the invention.

Figure 2:
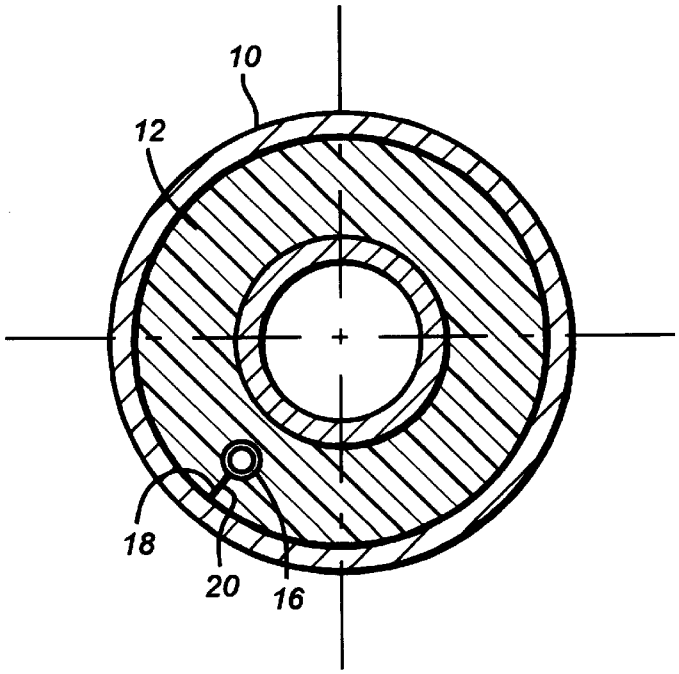
FIG. 2 is the view of FIG. 1, showing the sealing element enveloping the control line or I-wire while in the set position against the casing, tubular or the wellbore.
Figure 1A:
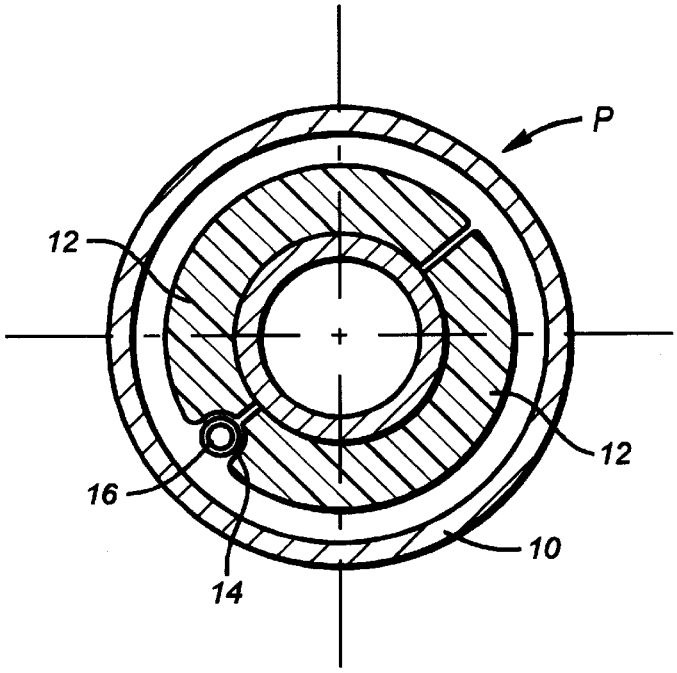
FIGS. 1*a* and 2*a* represent the views of FIGS. 1 and 2 showing the segmented design for the sealing element.
Figure 3A:
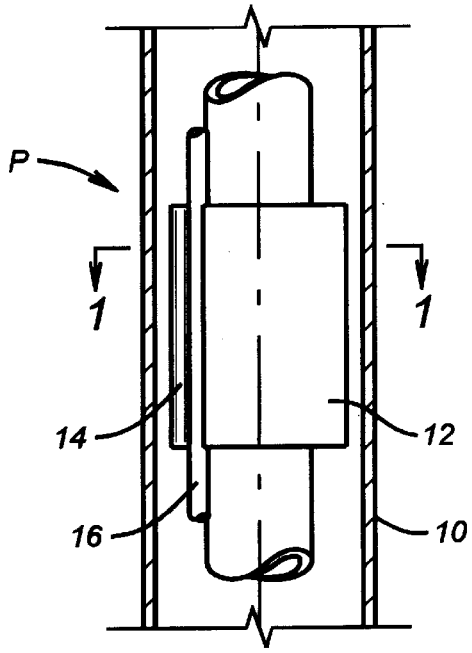
FIGS. 3*a* and 3*b* are elevated views of the section in FIGS. 1 and 2 showing a conduit or conductor extending through the element.
Figure 2A:
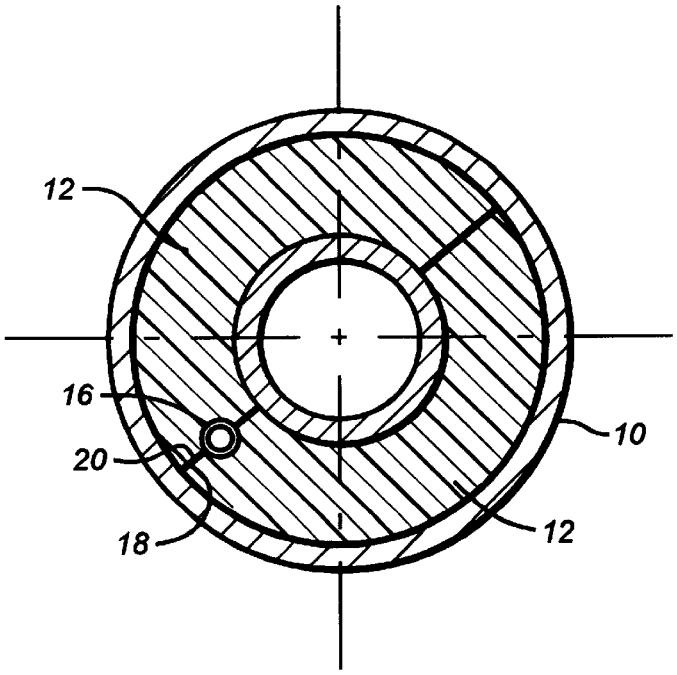
Figure 3B:
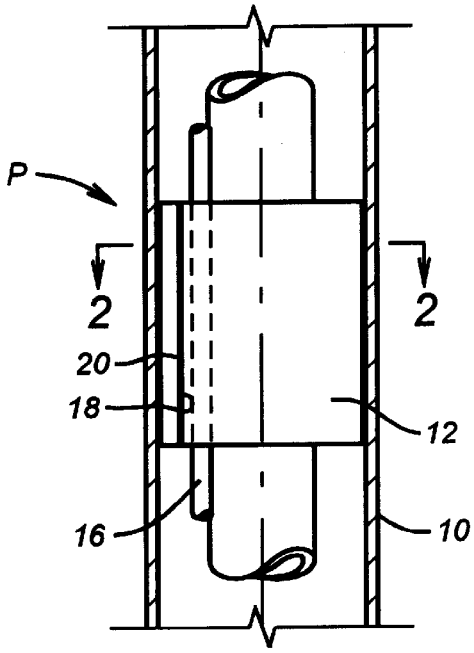

When the element 12 is squeezed from above and below as previously described, it expands radially as indicated in FIG. 2 into contact with the casing 10. The groove 14 closes up around the control line or I-wire 16, preferably for the entire length of the sealing element 12. Although a groove going to the exterior face of the sealing element is illustrated, the passage to accommodate the conductor or I-wire can be oriented differently. For example, a longitudinal bore can be used instead of a groove. The sealing element can have a section left out to accommodate the conductor or I-wire. The sealing element can be made from a plurality of segments, longitudinally split so that they define by their gaps a place for the insertions of the conductor or I-wire.

The longitudinal squeezing of the element 12 expands the element until open groove 14 closes up as surfaces 18 and 20 connect. The control line or I-wire 16 is now firmly supported within the sealing element 12, while the sealing element 12 is securely pressed against the casing 10. Those skilled in the art will realize that the control line or I-wire 16 can go through more than one packer in a given string if it is suitably accommodated with the groove 14. The groove 14 is sufficiently oversized with respect to the control line or I-wire 16 to allow easy insertion into the groove 14.

Additionally, the groove 14 is preferably oversized with respect to the control line or I-wire 16 to allow it to easily close up around the control line or I-wire 16.

It can readily be seen that leak paths through the packer, using prior techniques which had connection in the mandrel above and below the sealing element for connecting the control line or I-wire, are now eliminated. The control line or I-wire 16 is completely surrounded with the sealing element 12 with the same degree of force that the sealing element 12 exerts against the casing 10. Thus, the act of setting the packer P assures a reliability of seal around the control line or I-wire 16 with the same integrity as the seal against the casing 10. Connections and fittings are eliminated, and joints in the control or connections in the I-wire are also eliminated. The control line or I-wire can now run continuously from the surface to the downhole component without intermediate joints, which were previously needed to get beyond packers. Assembly of the tubing string with the control line or I-wire is greatly expedited because the need to put together connections at the packer is eliminated. The overall reliability of the I-wire or control line system is also enhanced by this elimination of joints. Although one conductor or I-wire is illustrated, it is within the scope of the invention to run multiple I-wires or conductors or combinations of these or other longitudinally oriented items through one or more sealing elements such as 12.

The foregoing disclosure and description of the invention are illustrative and explanatory thereof, and various changes in the size, shape and materials, as well as in the details of the illustrated construction, may be made without departing from the spirit of the invention.

What is claimed is:

1. A packer for a wellbore or tubular, comprising:

a body having a longitudinal axis;

a sealing element on said body having an outer surface and having a top and bottom and movable between a retracted position for run-in and an expanded position for contact with the tubular or the wellbore;

said sealing element comprising a passage extending from said top to said bottom to accommodate at least one elongated object which needs to extend beyond the sealing element in the wellbore;

said sealing element sealingly surrounds the elongated object when in an expanded position;

said passage comprising an open trough extending from an outer surface of the sealing element; and said outer surface when contacting the wellbore or tubular sealingly encloses said trough around the elongated object.

2. The packer of claim 1, further comprising:

a control line extending through said passage.

3. The packer of claim 2, further comprising:

an I-wire extending through said passage.

4. A wellbore or tubular packer comprising:

a. a body having a longitudinal axis;

b. a sealing element on said body having a outer surface and having a top and bottom and movable between a retracted position for run-in and an expanded position for contact with the tubular wellbore;

c. said sealing element comprising a circle like passage located at the outer periphery of said sealing element, extending from said top to said bottom to accommodate at least one elongated object which needs to extend beyond the sealing element in the wellbore; and d. said sealing element is in segments; said passage defined between two of said segments.

5. A method of running at least one control line I-wire. or an elongated object past a packer, comprising:

providing a longitudinal passage in a sealing element on the packer, extending the control line, I-wire, or elongated object through said passage;

expanding the sealing element to close off a wellbore passage; and sealingly engaging and surrounding the control line, I-wire or elongated object with said sealing element as a result of said expanding:

providing an external trough extending from an outer surface of said sealing element to act as said passage.

6. The method of claim 5, further comprising:

providing a bore through said sealing element to act as said passage.

7. The method of claim 5, further comprising:

providing a loose fit for said control line, I-wire or elongated object in said passage during run in.

8. The method of claim 7, further comprising:

closing said loose fit to sealing engage said control line,I-wire or elongated object as a result of setting the packer.

9. The method of claim 5, further comprising closing said trough around said control line, I-wire elongated object when setting the packer.

10. A method of running at least one control line one 1-wire, or an elongated object past a packer, comprising:

providing a longitudinal passage accessible to an outer surface of a sealing element on the packer;

extending the control line, I-wire, or elongated object through said passage;

expanding the sealing element to close off a wellbore passage; and sealingly engaging the control line, I-wire or elongated object with said sealing element as a result of said expanding;

providing a segmented sealing element such that said passage is defined by a circle like opening at said outer surface between adjacent segments.

* * * * *